US010246964B2

(12) United States Patent
Kam et al.

(10) Patent No.: US 10,246,964 B2
(45) Date of Patent: Apr. 2, 2019

(54) CASING HANGER RETENTION SYSTEM

(71) Applicant: Cameron International Corporation, Houston, TX (US)

(72) Inventors: Isaac Weng Chun Kam, Singapore (SG); Shuang Yong Cheah, Singapore (SG); Haw Keat Lim, Singapore (SG); Choon Seng Koa, Singapore (SG); Choon Keat Lai, Singapore (SG); Yen Hau Kok, Singapore (SG)

(73) Assignee: Cameron International Corporation, Houston, TX (US)

( * ) Notice: Subject to any disclaimer, the term of this patent is extended or adjusted under 35 U.S.C. 154(b) by 192 days.

(21) Appl. No.: 14/970,141

(22) Filed: Dec. 15, 2015

(65) Prior Publication Data

US 2017/0167217 A1 Jun. 15, 2017

(51) Int. Cl.
*E21B 33/04* (2006.01)

(52) U.S. Cl.
CPC ..... *E21B 33/04* (2013.01)

(58) Field of Classification Search
CPC ..... E21B 33/10
See application file for complete search history.

(56) References Cited

U.S. PATENT DOCUMENTS 3,273,646 A 9/1966 Walker
3,999,604 A 12/1976 Amancharla et al.
4,597,448 A 7/1986 Baugh
5,127,478 A 7/1992 Miller
8,978,772 B2 3/2015 Yates et al.
2005/0252653 A1* 11/2005 Vanderford ..... E21B 33/04 166/75.14
2013/0319688 A1 12/2013 Moellendick
2014/0311753 A1 10/2014 Hanson et al.

FOREIGN PATENT DOCUMENTS

SG 195468 A1 12/2013

OTHER PUBLICATIONS

PCT International Search Report & Written Opinion for PCT Application No. PCT/US2016/066403 dated Apr. 10, 2017; 13 Pages.

* cited by examiner

*Primary Examiner* — Giovanna C. Wright
*Assistant Examiner* — Yanick A Akaragwe
(74) *Attorney, Agent, or Firm* — Fletcher Yoder, P.C.

(57) ABSTRACT

A system includes a housing of a wellhead, a hanger configured to be positioned within the housing of the wellhead, and a hanger retention system. The hanger retention system includes a key-slot interface having at least one retention segment configured to move between a collapsed position in which the at least one retention segment does not block movement of the hanger relative to the housing of the wellhead and an engaged position in which the at least one retention segment engages at least one corresponding slot to block movement of the hanger relative to the housing of the wellhead. The at least one retention segment includes a wavy cross-sectional shape at least while the at least one retention segment is in the engaged position that enables the at least one retention segment to move between the collapsed position and the engaged position.

20 Claims, 8 Drawing Sheets

12
65
64
72
78
60
68
83
81
75
85
79
74
106
28
70
54
58
56
62

CASING HANGER RETENTION SYSTEM

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. These systems may be located onshore or offshore depending on the location of a desired resource. Further, such systems generally include a wellhead through which the well is drilled. These wellheads may include a wide variety of components and/or conduits, such as various casings, hangers, valves, fluid conduits, and the like, that control drilling and/or extraction operations. In drilling and production systems, a hanger may be used to suspend strings (e.g., piping) within the well to facilitate extraction of the resource. Such hangers may be disposed within and supported by a housing (e.g., a spool or a bowl) of the wellhead.

In some cases, a tool may be used to lower the hanger to a landed position within the wellhead. After reaching the landed position, the hanger may be locked (e.g., mechanically locked) into position within the wellhead. Unfortunately, some hangers may move relative to the wellhead during the period of time between reaching the landed position and being locked into position.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
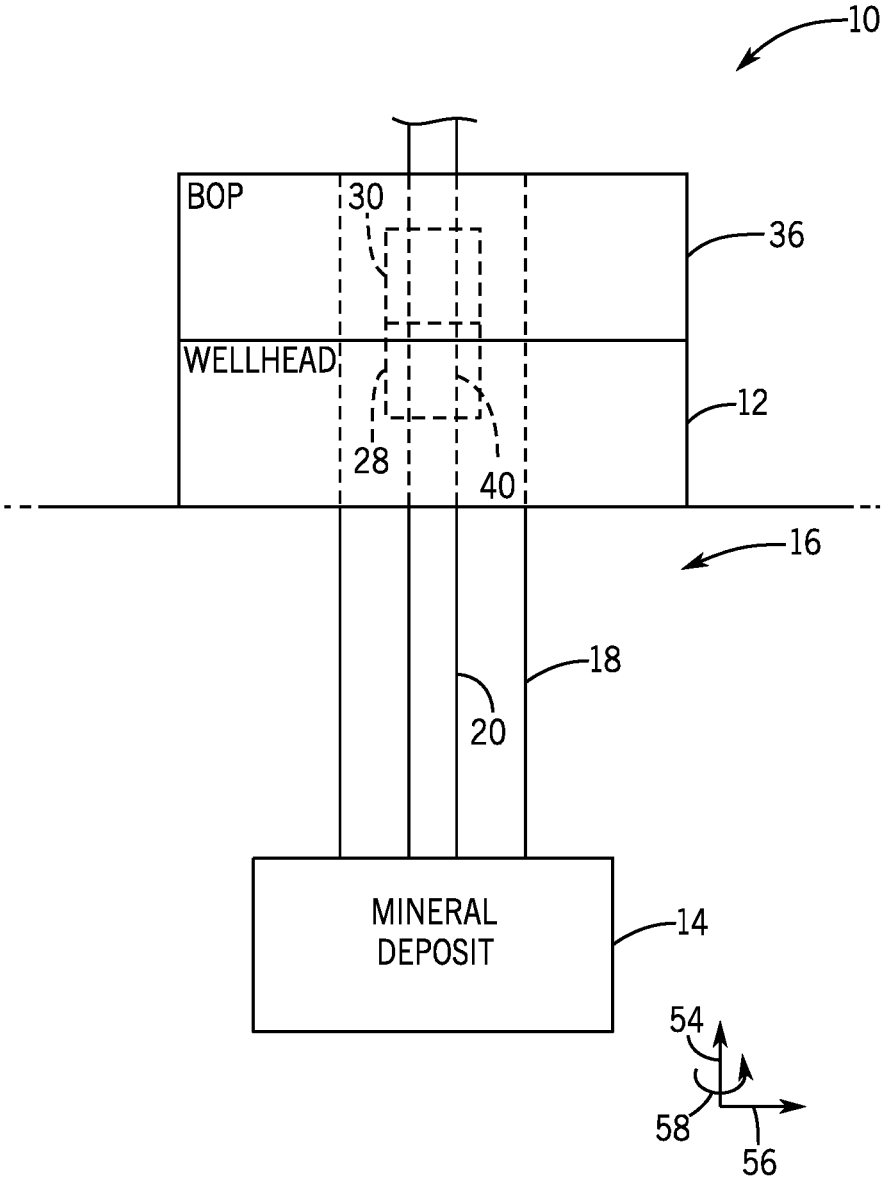
FIG. 1 is a block diagram of a mineral extraction system in accordance with an embodiment of the present disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present disclosure relate generally to a hanger retention system that is configured to retain a hanger within a wellhead of a mineral extraction system. For example, the hanger retention system may be configured to support (e.g., maintain or hold) the hanger in a landed position within a wellhead at least during a time period between landing the hanger in the wellhead and mechanically locking the hanger within the wellhead with a locking assembly. In some embodiments, the hanger retention system may be configured to block movement of the hanger relative to the wellhead during the time period and/or during cementing operations, for example.

In certain embodiments, the hanger retention system is a key-slot system having a key-slot interface. The hanger retention system may include at least one retention segment (e.g., key) configured to fit within (e.g., engage) a corresponding slot to couple the hanger to the wellhead (e.g., to block movement of the hanger relative to the wellhead). The retention segment may be coupled to the hanger and the corresponding slot may be position in a housing of the wellhead, or vise versa. For example, in certain embodiments, at least one retention segment may be coupled to a radially-outer surface of the hanger, may extend about at least a portion of a circumference of the hanger, and may be configured to engage a corresponding slot formed in a radially-inner surface of the housing of the wellhead. In some embodiments, multiple retention segments may be positioned at discrete locations about the circumference of the hanger and may be configured to engage one or more corresponding slots (e.g., an annular slot or multiple slots positioned at discrete locations about the circumference of the housing of the wellhead).

In some embodiments, the at least one retention segment may have a configuration that enables the at least one retention segment to collapse (e.g., radially) and expand (e.g., radially) to engage the corresponding slot. For example, as discussed in more detail below, the at least one retention segment may have a spring portion, which may include a wavy portion (e.g., curved, oscillating, or sinusoidal), elastic material, or both. The spring portion enables the at least one retention segment to move between a collapsed position and an expanded position to engage the corresponding slot. Certain disclosed embodiments may advantageously provide a simple, low-cost hanger retention system configured to block movement of the hanger relative to the wellhead during installation of the hanger (e.g., during cementing operations and/or during a time period between landing and locking the hanger). Thus, the disclosed hanger retention system may facilitate efficient installation of the hanger and/or accurate positioning of the hanger within the wellhead.

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or offshore (e.g., an offshore platform system). As illustrated, the system 10 includes a wellhead 12 coupled to a mineral deposit 14 via a well 16. The well 16 may include a well bore 18.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore 18. The system 10 may include other devices that are coupled to the wellhead 12, and devices that are used to assemble and control various components of the wellhead 12. For example, in the illustrated embodiment, the system 10 includes a hanger running tool 30 that may be used to lower the hanger 28 to a landed position within the wellhead 12. A pressure controlling system 36 (e.g., a blowout preventer [BOP], diverters, spacers, risers, adapters, and the like) may also be included as a part of the mineral extraction system 10. The pressure controlling system 36 may consist of a variety of valves, fittings, and controls to prevent oil, gas, or other fluid from exiting the well in the event of an unintentional release of pressure or an overpressure condition during a drilling phase.

As will be appreciated, the well bore 18 may contain elevated pressures. Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 28 is disposed within the wellhead 12 to secure tubing and casing suspended in the well bore 18, and to provide a path for hydraulic control fluid, chemical injections, and so forth. The hanger 28 includes a hanger bore 40 that extends through the center of the hanger 28, and that is in fluid communication with and provides pressure integrity with a bore of the hanger running tool 30 and a tubing string 20 during an installation phase. To facilitate discussion, the mineral extraction system 10 of FIG. 1, and the components therein, may be described with reference to an axial axis or direction 54, a radial axis or direction 56, and a circumferential axis or direction 58.

Figure 2:
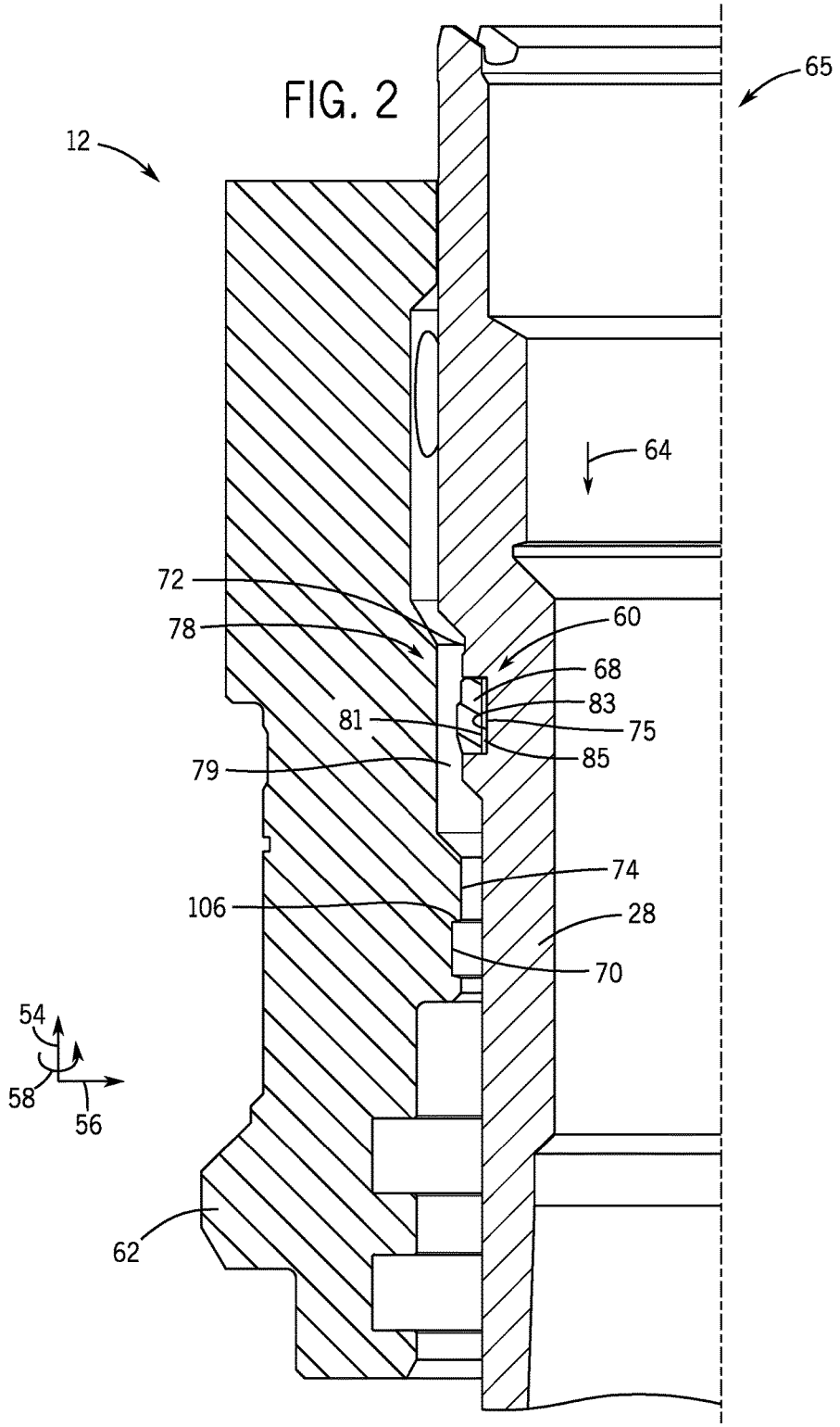
FIG. 2 is a side cross-section of a portion of a hanger retention system that may be used to retain a hanger within a wellhead of the mineral extraction system of FIG. 1 in accordance with an embodiment of the present disclosure.

FIG. 2 is a side cross-section of an embodiment of a portion of a hanger retention system 60 that may be used to retain the hanger 28 within a housing 62 of the wellhead 12. In operation, the hanger 28 may be lowered into the housing 62 (e.g., via the hanger running tool 30) in the axial direction 54, as shown by arrow 64, from the illustrated raised position 65 to a landed position within the wellhead 12. The hanger retention system 60 includes a key-slot interface having at least one retention segment 68 (e.g., key, engaging member, spring lock segment, wavy lock segment, wavy spring segment, split ring with wavy segments) and at least one corresponding slot 70 (e.g., recess or groove). The retention segment 68 may be part of or coupled to the hanger 28 and the corresponding slot 70 may be part of or coupled to the housing 62, or vice versa. In the illustrated embodiment, the retention segment 68 is coupled (e.g., fastened via a threaded fastener) to a radially-outer surface 72 of the hanger 28 and the corresponding slot 70 is formed in a radially-inner surface 74 of the housing 62. As shown, the retention segment 68 is positioned within a recess 75 formed in the radially-outer surface 72 of the hanger 28. The retention segment 68, the corresponding slot 70, and/or the recess 75 may extend about at least a portion of the circumference of the hanger 28. In some embodiments, multiple retention segments 68 may be provided at discrete locations about the circumference of the hanger 28 (e.g., circumferentially spaced segments 68). In some such cases, the multiple retention segments 68 may be positioned within an annular recess 75 or respective discrete recesses 75 (e.g., circumferentially spaced recesses 75) formed about the hanger 28, and/or the multiple retention segments 68 may be configured to engage an annular corresponding slot 70 or respective discrete corresponding slots 70 formed in the housing 62. While the hanger retention system 60 illustrated herein includes separate retention segments 68, it should be understood that the retention segments 68 may be coupled to one another, form a one-piece ring, or be part of or form an annular ring or split ring.

While the hanger 28 is in the illustrated raised position 65, the retention segment 68 is in a radially expanded position 78 in which the retention segment 68 extends radially outward from the recess 75 and/or from the radially-outer surface 72 of the hanger 28 into an annular space 79 between the housing 62 and the hanger 28. In certain embodiments, in the expanded position 78, at least a portion of a radially-inner surface 81 of the retention segment 68 does not contact (e.g., is separated from) a surface 83 (e.g., annular surface) of the recess 75. Thus, in certain embodiments, there may be at least one space 85 (e.g., a gap or a radial gap) between the retention segment 68 and the hanger 28 when the retention segment 68 is in the expanded position 78.

Figure 3:
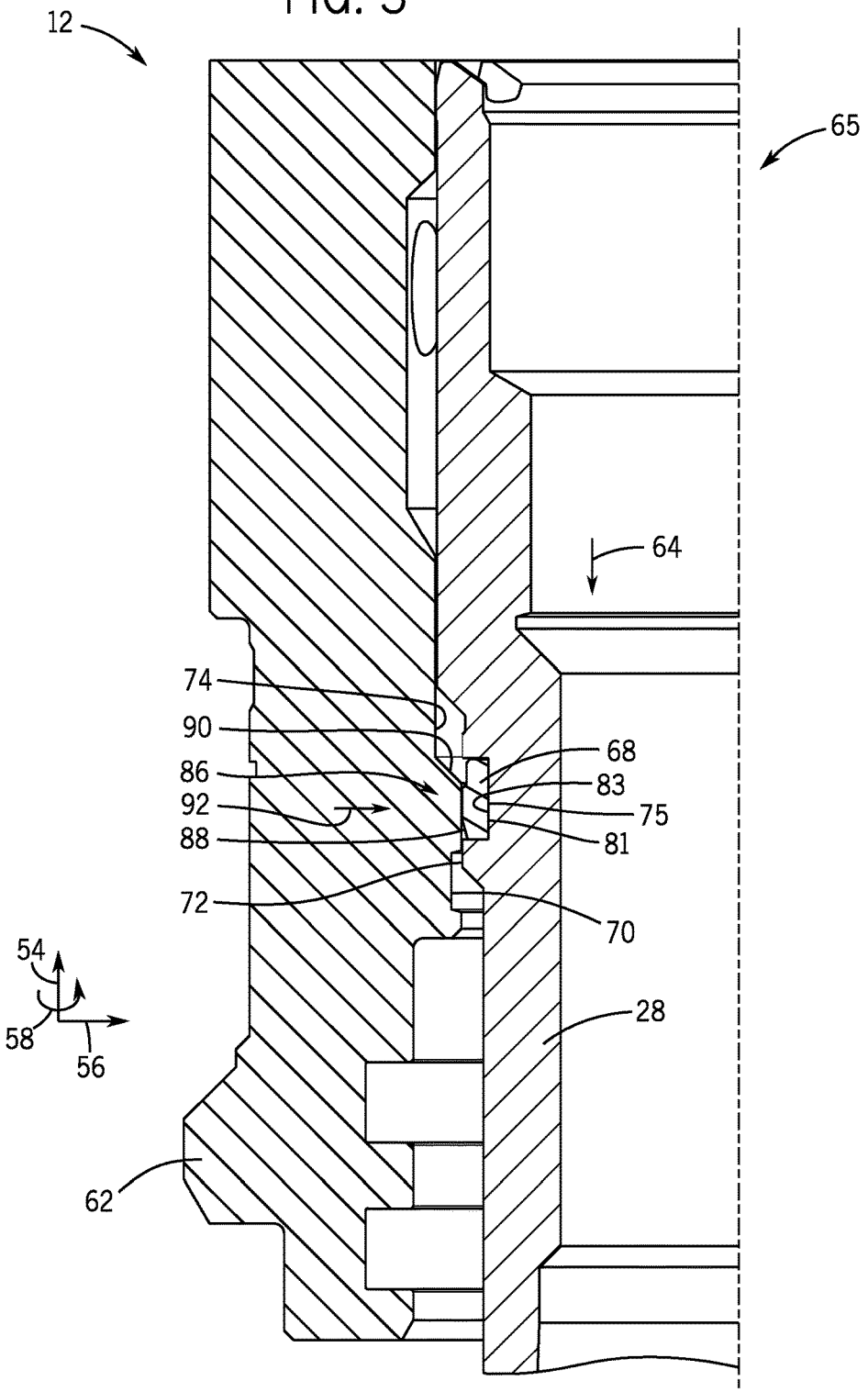
FIG. 3 is a side cross-section of the portion of the hanger retention system of FIG. 2, wherein a retention segment of the hanger retention system is in a collapsed position in accordance with an embodiment of the present disclosure.

FIG. 3 is a side cross-section of the portion of the hanger retention system 60 in which the retention segment 68 is in a radially contracted or collapsed position 86. In the collapsed position 86, the retention segment 68 may not extend radially outward from the recess 75 and/or from the radially-outer surface 72 of the hanger 28. In certain embodiments, in the collapsed position 86, an entirety of the radially-inner surface 81 of the retention segment 68 may contact the surface 83 of the recess 75, relatively more (e.g., as compared to the expanded position 78) of the radially-inner surface 81 of the retention segment 68 may contact the surface of the recess 75, and/or a maximum radial distance across the space 85 may be relatively smaller (e.g., as compared to the expanded position 78).

In the illustrated embodiment, as the hanger 28 is lowered into the housing 62, as shown by arrow 64, a lower tapered surface 88 (e.g., circumferentially-extending surface) of the hanger retention segment 68 contacts the radially-inner surface 74 of the housing 62 (e.g., a tapered annular portion 90 of the radially-inner surface 74 of the housing 62). Upon contact between the retention segment 68 and the radially-inner surface 74, the hanger retention segment 68 may move (e.g., radially inward) from the expanded position 78 to the collapsed position 86, as shown by arrow 92, thereby enabling the hanger 28 to move downward through the housing 62.

Figures 4, 5:
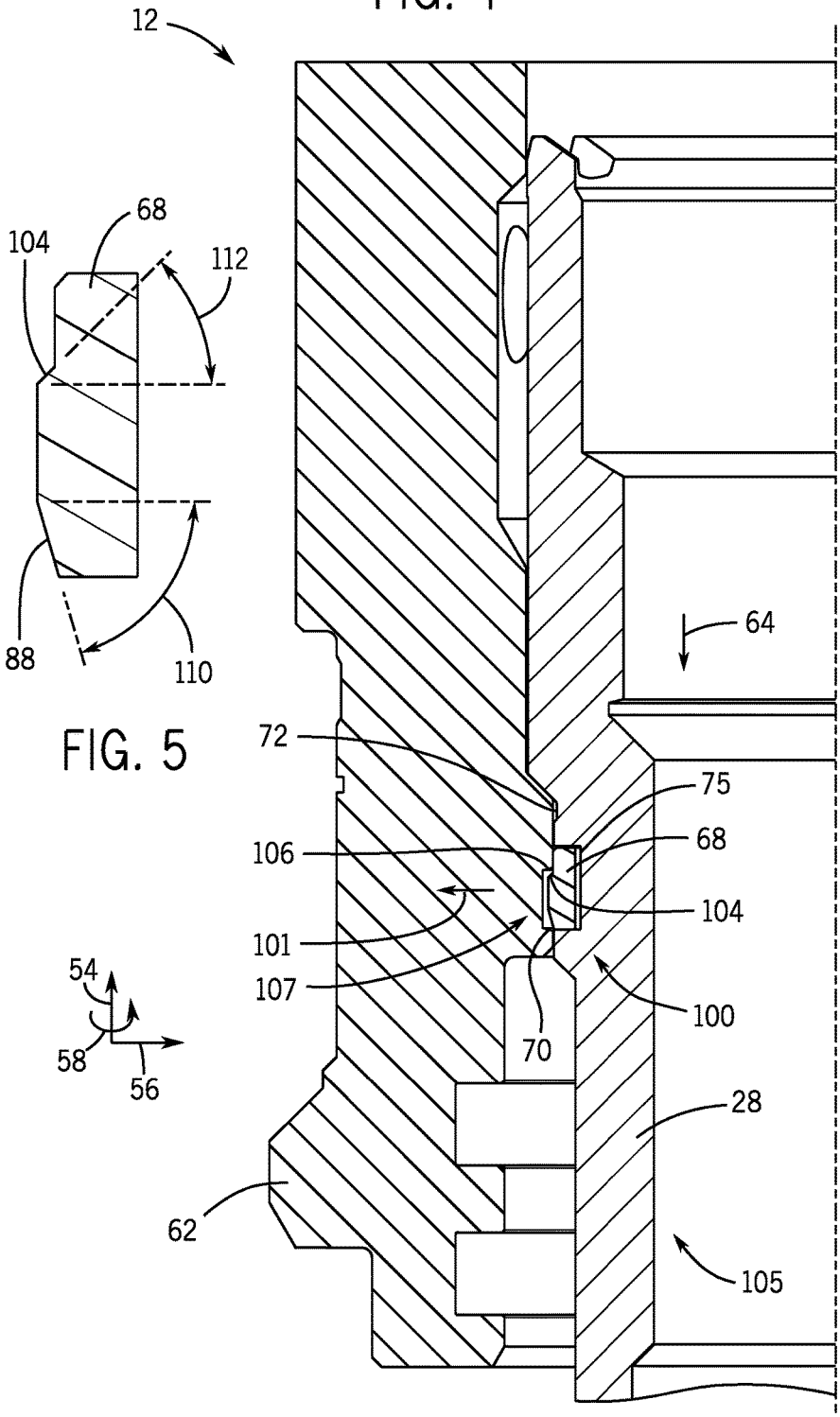
FIG. 4 is a side cross-section of the portion of the hanger retention system of FIG. 2, wherein a retention segment of the hanger retention system is in an expanded position and engages a housing of the wellhead in accordance with an embodiment of the present disclosure.
FIG. 5 is a side cross-section of a retention segment that may be used in the hanger retention system of FIG. 2 in accordance with an embodiment of the present disclosure.

FIG. 4 is a side cross-section of the portion of the hanger retention system 60 in which the retention segment 68 is in an engaged position 100. In the engaged position 100, the retention segment 68 engages the corresponding slot 70, thereby blocking movement of the hanger 28 relative to the housing 62 of the wellhead 12. In the engaged position 82, an upper engaging surface 104 of the retention segment 68 may contact a lower engaging surface 106 of the corresponding slot 70 and/or the upper engaging surface 104 and the lower engaging surface 106 may overlap in the radial direction 56, thereby blocking movement of the hanger 28 relative to the housing 62 of the wellhead 12. For example, the retention segment 68 may block movement (e.g., in the axial, radial, and/or circumferential direction) of the hanger 28 relative to the housing 62 of the wellhead 12 during cementing operations, mechanical locking of the hanger 28 to the housing 62 via a locking assembly, or the like. The retention segment 68 and/or the corresponding slot 70 form a key-slot interface 107.

As the hanger 28 is lowered into the housing 62, as shown by arrow 64, the retention segment 68 may move (e.g., radially outward), as shown by arrow 101, from the collapsed position 86 to the engaged position 100 when the retention segment 68 is axially aligned with the corresponding slot 70. In the engaged position 100, the retention segment 68 may be in the expanded position 78 or a partially-expanded position (e.g., a position along the radial axis 56 between the expanded position 78 and the collapsed position 86) in which the retention segment 68 extends radially-outward from the recess 75 and/or the radially-outer surface 72 of the hanger 28. The corresponding slot 70 may be positioned axially along the housing 72 such that the retention segment 68 moves (e.g., automatically moves) to the engaged position 100 when the hanger 28 reaches a landed position 105 within the housing 62. In the landed position 105, the hanger 28 may be supported by and blocked from moving downward by an axially-facing surface of the housing, another hanger, or other component located axially below the hanger 28, for example.

FIG. 5 is a side cross-section of an embodiment of the retention segment 68. As shown, the lower tapered surface 88 may be positioned at a first angle 110 relative to the radial axis 56 and/or the upper engaging surface 104 of the hanger retention segment 68 may be positioned at a second angle 112 relative to the radial axis 56. In some embodiments, the first angle 110 may be greater than the second angle 112. In some embodiments, the second angle 112 may be less than or equal to about 10, 20, 30, 40, 50, 60, or 70 percent of the first angle 110. In some embodiments, the first angle 110 may be greater than about 45 degrees and/or the second angle 112 may be less than about 45 degrees. In certain embodiments, the first angle 110 may be greater than or equal to about 25, 30, 35, 40 45, 50, 60, 70, or 80 degrees, and/or the second angle 112 may be less than or equal to about 30, 25, 20, 15, or 10 degrees. In certain embodiments, the first angle 110 may be between about 30 to 80, 45 to 70, or 50 to 60 degrees, and/or the second angle 112 may be between about 10 to 45, 15 to 40, 20 to 35, or 25 to 30 degrees. The first angle 110 may be configured to enable efficient landing the hanger 28 and/or the second angle 112 may be configure to facilitate retention of the retention segment 68 within the corresponding slot 70. For example, a downward force that causes the retention segment 68 to move from the expanded position 78 to the collapsed position 86 upon contact with the radially-inner surface 74 of the housing 62 to enable the hanger 28 to reach the landed position 105 may be less than an upward force that causes the retention segment 68 to move from the engaged position 100 to the collapsed position 86 to enable axial movement (e.g., withdrawal) of the hanger 28 relative to the housing 62 of the wellhead 12. In certain embodiments, it may be desirable for the first angle to be less than the second angle 112.

Figure 6:
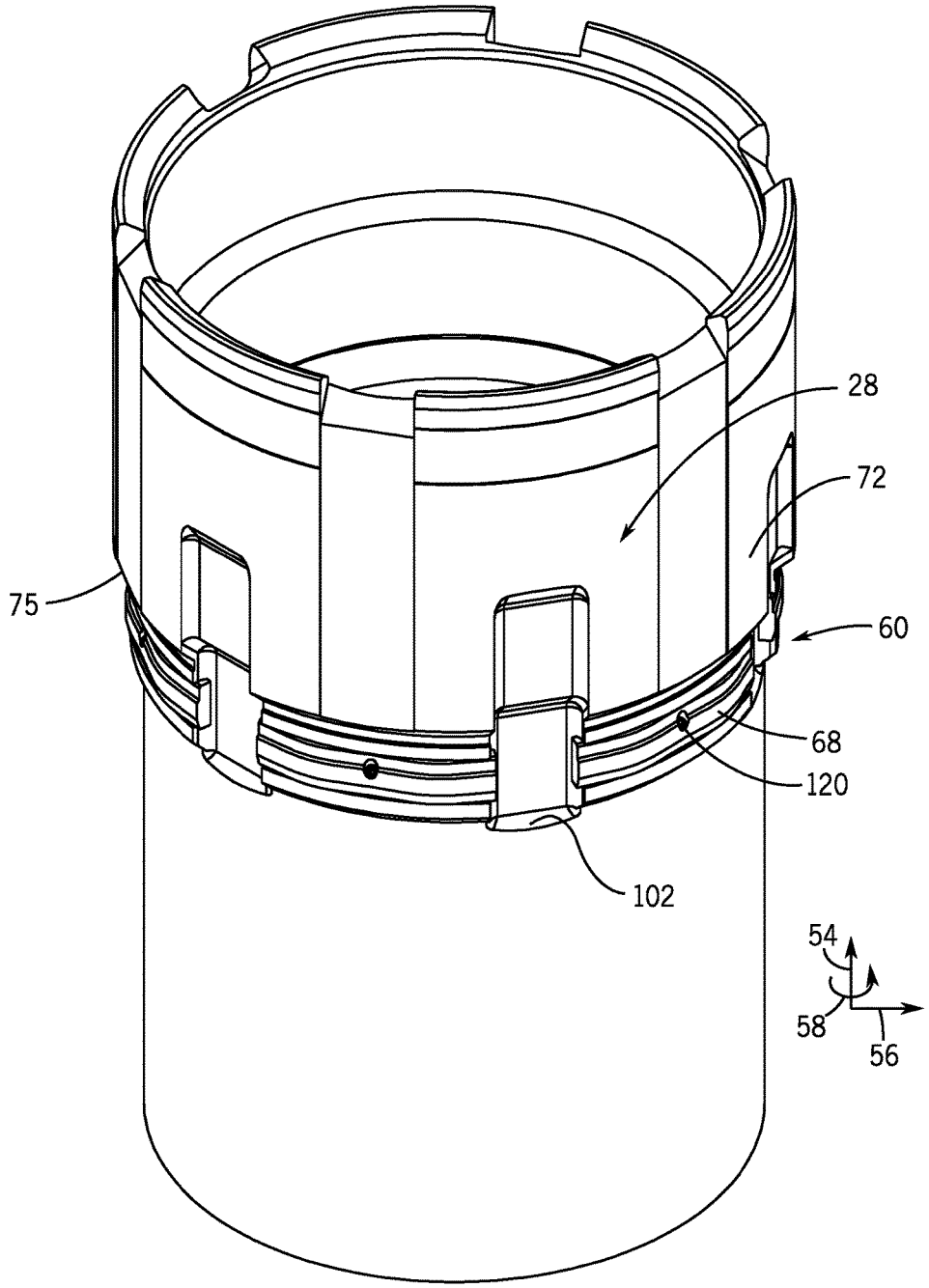
FIG. 6 is a perspective view of the hanger retention system of FIG. 2 in accordance with an embodiment of the present disclosure.

FIG. 6 is a perspective view of an embodiment of the hanger retention system 60 that may be used to couple the hanger 28 to the housing 62 of the wellhead 12. The hanger retention system 60 may include one or more retention segments 68 extending about at least a portion of a circumference of the hanger 28. In the illustrated embodiment, the hanger retention system 60 includes multiple retention segments 68 positioned at discrete locations about a circumference of the hanger 28. Each of the retention segments 68 is coupled (e.g., via a respective threaded fastener 120) to the hanger 28. Although one fastener 120 is shown for each retention segment 68, any suitable number (e.g., 1, 2, 3, 4, 5, 6, 7, 8, or more) fasteners 120 in any suitable position may be used to couple each retention segment 68 to the hanger 28. It should be understood that each retention segment 68 may be coupled to the hanger 28 via any suitable fastener, including a key, notch, hook, latch, dovetail join, adhesive, or the like.

As shown, each hanger retention segment 68 is positioned within the recess 75 of the hanger 28. In certain embodiments, the recess 75 may be annular and extend about the circumference of the hanger 28, or a discrete respective recess 75 may be provided for each retention segment 68. As shown, one or more gaps 102 between adjacent retention segments 68 are provided about the circumference of the hanger 28. The one or more gaps 102 may provide a flow path for fluid (e.g., cement, gas, or the like) during installation of the hanger 28, cementing operations, or the like.

Figure 7:
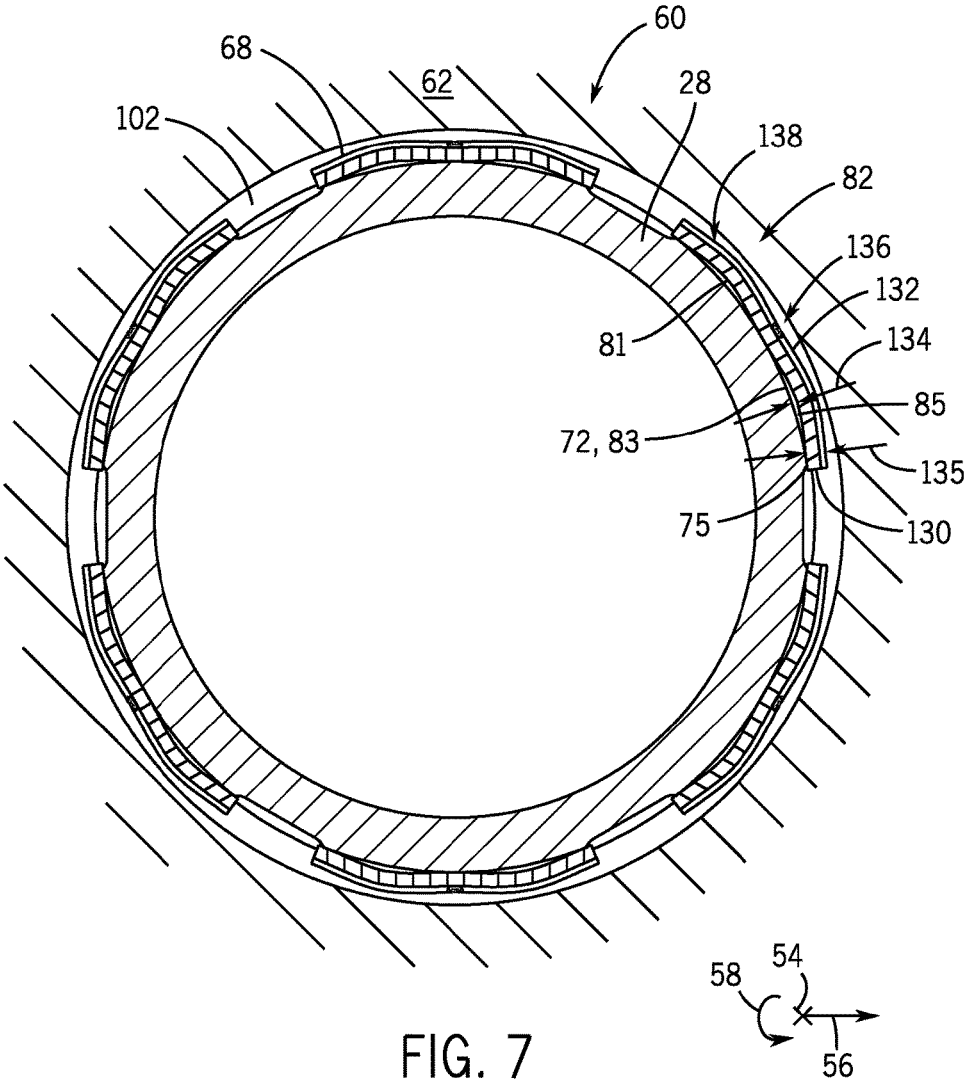
FIG. 7 is a top cross-section of the hanger retention system of FIG. 2, wherein each retention segment of the hanger retention system is in an expanded position in accordance with an embodiment of the present disclosure.

FIG. 7 is a top cross-section of an embodiment of the hanger retention system 60 with each retention segment 68 in the expanded position 78. In the illustrated embodiment, multiple retention segments 68 are positioned at discrete locations about the circumference of the hanger 28. As shown, six retention segments 68 are spaced evenly about the circumference of the hanger 28, and adjacent retention segments 68 are separated by a respective gap 102. Each retention segment 68 includes a body 130 having a radially-outer surface 132 and the radially-inner surface 81.

In the illustrated embodiment, the body 130 is a spring-like member having a spring portion that enables the retention segment 68 to move between the expanded position 78 and the collapsed position 86. For example, as shown, the body 130 has a wavy portion (e.g., curved, oscillating, or sinusoidal) with a wavy cross-sectional shape extending in the circumferential direction 58. Additionally or alternatively, in certain embodiments, the body 130 may have a wavy portion that extends in the axial direction 54 and/or the radial direction 56, as discussed in more detail below. In certain embodiments, at least a portion of the radially-inner surface 81 of each retention segment 68 is separated from the surface 83 of the recess 75 and/or the radially-outer surface 72 of the hanger 28 by the space 85 while the retention segment 68 is in the expanded position 78. The space 85 may define a radial distance 134 between the radially-inner surface 81 of the retention segment 68 and the surface 83 of the recess 75 and/or the radially-outer surface 72 of the hanger 28.

In certain embodiments, each retention segment 68 may include one or more peak regions 138 and one or more valley regions 136 relative to a baseline curvature of the retention segment 68 (e.g., a baseline curvature that has a radius of curvature that corresponds to or tracks the respective radius of curvature of the hanger 28 and the housing 62). The retention segment 68 may be coupled to the hanger 28 at the one or more valley regions 136 (e.g., via the fastener 120), and the retention segment 68 may be separated from the hanger 28 by the radial distance 134 at the one or more peak regions 138 while the retention segment 68 is in the expanded position 78. In certain embodiments, the radial distance 134 may be greater than or equal to about 5, 10, 15, 20, 25, 30, 35, 40, 45, or 50 percent of a radial thickness 135 of the body 130. It should be understood that any suitable number (e.g., 1, 2, 3, 4, 5, 6, 7, 8, 9, 10, or more) valley regions 136 and/or peak regions 138 may be provided. As discussed above, in operation, each retention segment 68 is configured to move between the expanded position 78 and the collapsed position 86.

Figure 8:
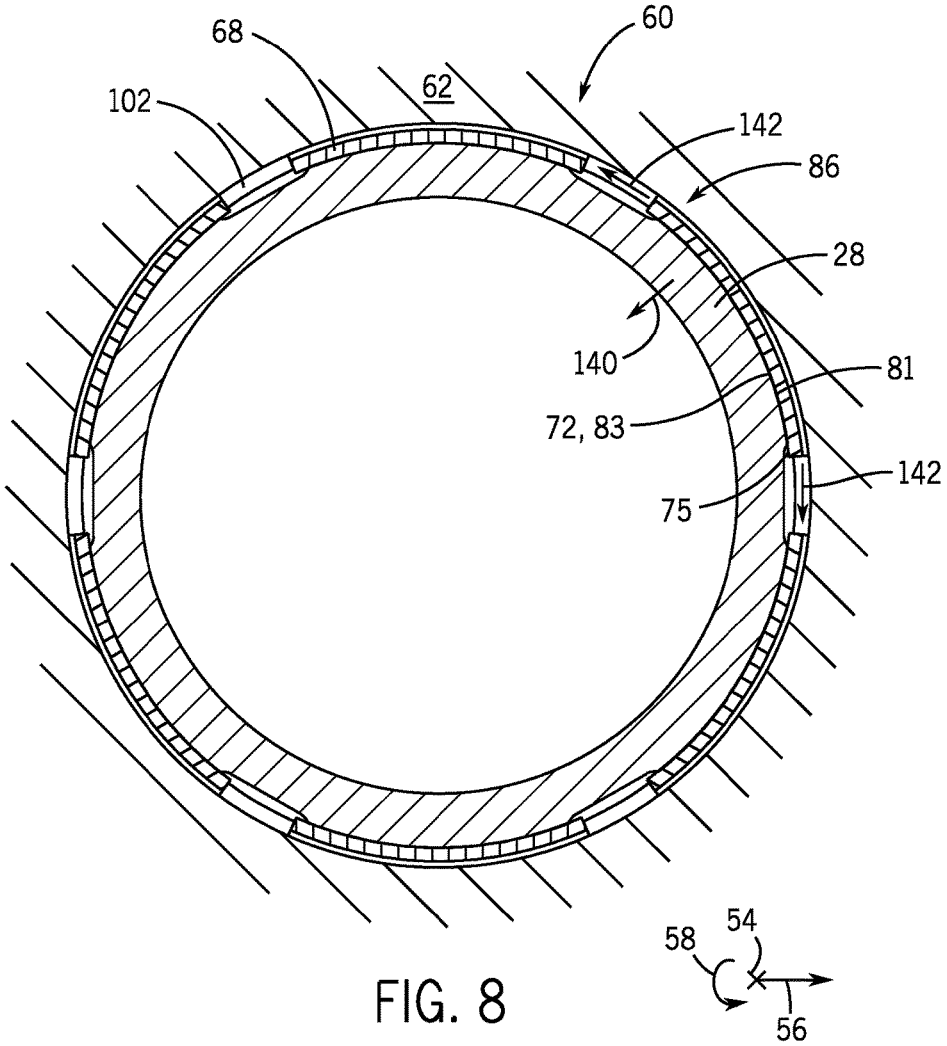
FIG. 8 is a top cross-section of the hanger retention system of FIG. 2, wherein each retention segment of the hanger retention system is in a collapsed position in accordance with an embodiment of the present disclosure.

FIG. 8 is a top cross-section of the hanger retention system 60 in which each retention segment 68 is in the collapsed position 86. For example, as the retention segment 68 is driven to the collapsed position 86 due to contact with the housing 62 in the manner discussed above with respect to FIG. 3, the retention segment 68 moves radially, as shown by arrow 140, and circumferentially, as shown by arrow 142. In the illustrated collapsed position 86, an entirety of the radially-inner surface 81 of the retention segment 68 contacts the surface 83 of the recess 75 and the space 85 is absent. In certain embodiments, in the collapsed position 86, relatively more (e.g., as compared to the expanded position 78) of the radially-inner surface 81 of the retention segment 68 may contact the surface 83 of the recess 75, and/or the radial distance 134 across the space 85 may be relatively smaller (e.g., as compared to the expanded position 78).

Figure 9:
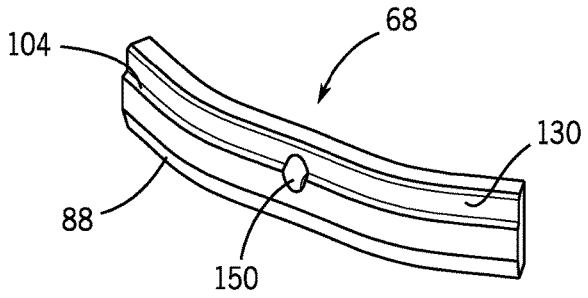
FIG. 9 is a perspective view of a retention segment of the hanger retention system of FIG. 2 in accordance with an embodiment of the present disclosure.

FIG. 9 is a perspective view of an embodiment of the retention segment 68 that may be part of the hanger retention system 60. As shown, the retention segment 68 includes the body 130 having the wavy cross-sectional shape. The retention segment 68 includes the lower tapered surface 88 and the upper engaging surface 104. The retention segment 68 may include an opening 150 configured to receive the fastener 120. The retention segment 68 may be formed from any suitable material, including a metal or metal alloy. The retention segment 68 is wavy in a lengthwise direction (e.g., along a length of the retention segment 68), which may correspond to the circumferential direction 58, the axial direction 54, or the radial direction 56 when applied to the hanger 28 or to the housing 62.

Figure 10:
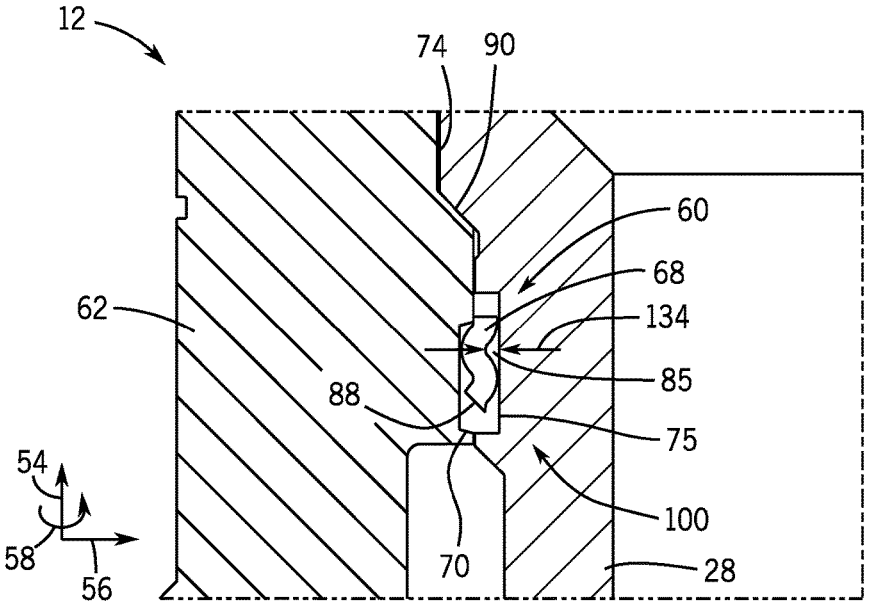
FIG. 10 is a side cross-section of a portion of a hanger retention system that may be used to retain a hanger within a wellhead of the mineral extraction system of FIG. 1, wherein a retention segment includes a wavy portion extending in an axial direction in accordance with an embodiment of the present disclosure.

As noted above, in certain embodiments, the hanger retention system 60 may additionally or alternatively include one or more retention segments 68 that include a spring portion having a wavy portion (e.g., curved, oscillating, or sinusoidal) that extends in the axial direction 54 and/or the radial direction 56. FIG. 10 is a side cross-section of an embodiment of the portion of the hanger retention system 60 in which the retention segment 68 includes a wavy portion extending in the axial direction 54. In the illustrated embodiment, the retention segment 68 is in the engaged position 100 and is positioned within the corresponding slot 70. Each retention segment 68 may extend about less than the circumference of the hanger 28, and adjacent retention segments 68 may be separated by respective gaps 102. Multiple retention segments 68 may be positioned at discrete circumferential locations about the hanger 28 (e.g., circumferentially spaced) in manner similar to that shown in FIG. 6.

When the hanger 28 is inserted into the housing 62 of the wellhead 12, the lower tapered surface 88 of the retention segment 68 contacts the radially-inner surface 74 of the housing 62 (e.g., the tapered annular portion 90 of the radially-inner surface 74 of the housing 62). Upon contact between the retention segment 68 and the radially-inner surface 74, the hanger retention segment 68 may move (e.g., radially inward and/or spread axially within the recess 75, thereby reducing the radial distance 134 across the space 85) from the expanded position 78 to the collapsed position 86, thereby enabling the hanger 28 to move downward through the housing 62. When the hanger 28 reaches the landed position 105, the retention segment 68 is axially aligned with the corresponding slot 70, which enables the retention segment 68 to move from the collapsed position 86 to the engaged position 100.

Figure 11:
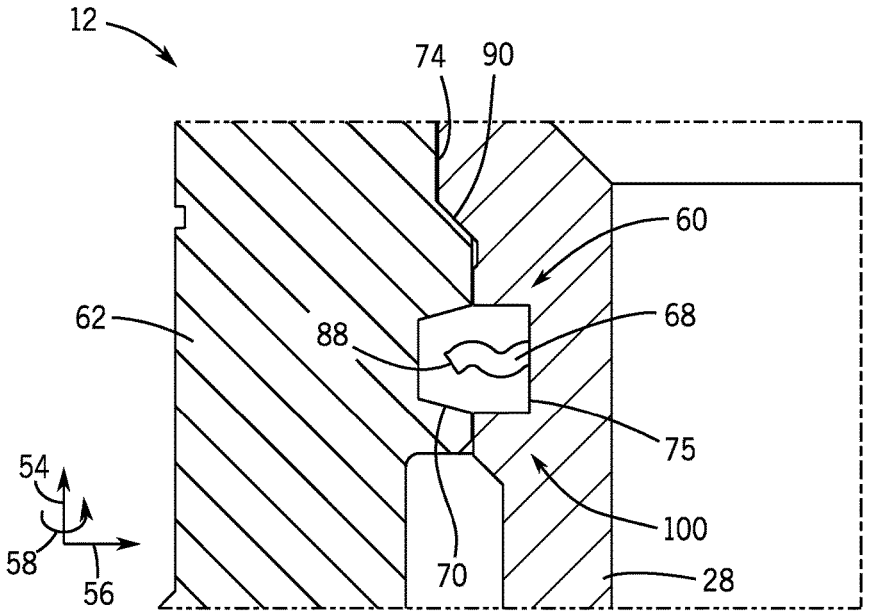
FIG. 11 is a side cross-section of a portion of a hanger retention system that may be used to retain a hanger within a wellhead of the mineral extraction system of FIG. 1, wherein a retention segment includes a wavy portion extending in a radial direction in accordance with an embodiment of the present disclosure.

As noted above, the components of the hanger retention system 60 may also be adapted to accommodate one or more retention segments 68 having a spring portion having a wavy portion that extends in the radial direction 56, thereby enabling the retention segments 68 to collapse and expand to engage the corresponding slot 70 and to block movement of the hanger 28 relative to the housing 62 of the wellhead 12. FIG. 11 is a side cross-section of the portion of the hanger retention system 60 in which the retention segment 68 includes a wavy portion extending in the radial direction 56. In the illustrated embodiment, the retention segment 68 is in the engaged position 100 and is positioned within the corresponding slot 70. Each retention segment 68 may extend about less than the circumference of the hanger 28, and adjacent retention segments 68 may be separated by respective gaps 102. Multiple retention segments 68 may be positioned at discrete circumferential locations about the hanger 28 (e.g., circumferentially spaced) in manner similar to that shown in FIG. 6.

When the hanger 28 is inserted into the housing 62 of the wellhead 12, the lower tapered surface 88 of the retention segment 68 contacts the radially-inner surface 74 of the housing 62 (e.g., the tapered annular portion 90 of the radially-inner surface 74 of the housing 62). Upon contact between the retention segment 68 and the radially-inner surface 74, the hanger retention segment 68 may move (e.g., radially inward within the recess 75) from the expanded position 78 to the collapsed position 86, thereby enabling the hanger 28 to move downward through the housing 62. When the hanger 28 reaches the landed position 105, the retention segment 68 is axially aligned with the corresponding slot 70, which enables the retention segment 68 to move radially outward from the collapsed position 86 to the engaged position 100.

The hanger retention system 60 may be used to block movement of the hanger 28 relative to the housing 62 of the wellhead 12 at least during a time period between landing and locking (e.g., via a locking assembly) the hanger 28. For example, in some systems, the hanger 28 is landed, and then the hanger 28 is subsequently locked within the housing 62 via a separate process at a later time. The disclosed hanger retention system 60 may retain the hanger 28 within the wellhead 12 (e.g., block movement of the hanger 28 relative to the wellhead 12) once the landed position 105 is reached. The hanger retention system 60 may also block movement of the hanger 28 relative to the wellhead 12 during cementing operations, thus enabling cementing operations to be initiated and/or completed prior to locking the hanger 28 within the housing 62 of the wellhead 12 via the locking assembly.

It should be understood that any of the various features illustrated and described with respect to FIGS. 1-11 may be combined in any suitable manner to enable installation of the hanger 28 within the housing 62 of the wellhead 12 and/or to block movement of the hanger 28 within the housing 62 of the wellhead. While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a housing of a wellhead;

a hanger configured to be positioned within the housing of the wellhead; and a hanger retention system comprising a key-slot interface, wherein the key-slot interface comprises at least one retention segment configured to move to a collapsed position in response to contact with a radially-extending surface as the hanger moves axially through the housing of the wellhead and to automatically move from the collapsed position to an engaged position in response to axial alignment with at least one corresponding slot, wherein the at least one retention segment enables axial movement of the hanger relative to the housing of the wellhead while in the collapsed position and the at least one retention segment engages and extends radially into the at least one corresponding slot to block axial movement of the hanger relative to the housing of the wellhead while in the engaged position, wherein the at least one retention segment comprises a spring-like member comprising a wavy cross-sectional shape along a length of the at least one retention segment at least while the at least one retention segment is in the engaged position that causes the at least one retention segment to automatically move between the collapsed position and the engaged position.

2. The system of claim 1, wherein the hanger retention system comprises multiple retention segments that are positioned at discrete locations about a circumference of the hanger, that each extend circumferentially about less than half of a circumference of the hanger, and that are each configured to engage the at least one corresponding slot.

3. The system of claim 2, comprising axially-extending gaps between adjacent retention segments of the multiple retention segments, wherein the axially-extending gaps are configured to enable a fluid to flow between the adjacent retention segments.

4. The system of claim 1, wherein the at least one retention segment is coupled to the hanger and the at least one corresponding slot is formed in the housing of the wellhead.

5. The system of claim 4, wherein the at least one retention segment is coupled to the hanger via a threaded fastener.

6. The system of claim 4, wherein the wavy cross-sectional shape extends in a circumferential direction about the hanger, the wavy cross-sectional shape comprises a peak region and a valley region, the peak region is biased radially-outwardly from the hanger to cause the at least one retention segment to automatically move from the collapsed position to the engaged position in response to axial alignment with the at least one corresponding slot, at least a portion of a radially-inner surface at the peak region of the at least one retention segment is separated from a radially-outer surface of the hanger by a first radial distance while the at least one retention segment is in the engaged position, and wherein the portion of the radially-inner surface at the peak region of the at least one retention segment contacts the radially-outer surface of the hanger or is separated from the radially-outer surface of the hanger by a second radial distance less than the first radial distance while the at least one retention segment is in the collapsed position.

7. The system of claim 1, wherein the at least one retention segment comprises a tapered lower surface extending at a first angle relative to a radial axis and an upper engaging surface extending at a second angle relative to the radial axis, and the first angle is greater than the second angle.

8. The system of claim 1, wherein the wavy cross-sectional shape comprises an oscillating cross-sectional shape that extends along a respective length of the at least one retention segment and that extends in a circumferential direction about the hanger when coupled to the hanger, the oscillating cross-sectional shape comprises at least one peak region and at least one valley region that cause the at least one retention segment to move between the collapsed position and the engaged position, and the cross-section is taken along a plane extending between a radial-inner surface and a radially-outer surface of the at least one retention segment.

9. A system, comprising:

a retention system comprising at least one retention segment configured to be coupled to a hanger and configured to move between a collapsed position in which the at least one retention segment does not block movement of the hanger relative to a housing of a wellhead and an engaged position in which the at least one retention segment engages and extends radially-outwardly into at least one corresponding slot formed in the housing of the wellhead to block movement of the hanger relative to the housing of the wellhead, wherein the at least one retention segment comprises a spring-like member comprising a wavy cross-sectional shape that extends along a length of the at least one retention segment to enable the at least one retention segment to automatically move to the collapsed position upon contact with a radially-inner surface of the housing of the wellhead as the hanger moves axially within the housing of the wellhead and automatically move from the collapsed position to the engaged position upon axial alignment with the at least one corresponding slot.

10. The system of claim 9, wherein the retention system comprises multiple retention segments positioned at discrete circumferential locations about the hanger, each retention segment of the multiple retention segments is configured to engage the at least one corresponding slot, and each retention segment of the multiple retention segments comprises a respective spring-like member comprising a respective wavy cross-sectional shape that extends along a respective length of each retention segment of the multiple retention segments and that extends circumferentially about the hanger when coupled to the hanger.

11. The system of claim 9, wherein the at least one retention segment is coupled to the hanger via a threaded fastener.

12. The system of claim 9, wherein the wavy cross-section shape comprises a peak region and a valley region, the peak region is biased radially-outwardly from the hanger when the at least one retention segment is coupled to the hanger, at least a portion of a radially-inner surface at the peak region of the at least one retention segment is separated from a radially-outer surface of the hanger by a first radial distance while the at least one retention segment is in the engaged position, wherein the portion of the radially-inner surface at the peak region of the at least one retention segment contacts the radially-outer surface of the hanger or is separated from the radially-outer surface of the hanger by a second radial distance less than the first radial distance while the at least one retention segment is in the collapsed position, and wherein the peak region and the valley region are configured to be separated from one another in a circumferential direction about the hanger when the at least one retention segment is coupled to the hanger.

13. The system of claim 9, wherein the at least one retention segment comprises a tapered lower surface extending at a first angle relative to a radial axis and an upper engaging surface extending at a second angle relative to the radial axis, and the first angle is greater than the second angle.

14. A system, comprising: a retention system comprising a key-slot interface, wherein the key-slot interface comprises a plurality of physically separate retention segments configured to be coupled to a first component of the system, wherein each of the plurality of physically separate retention segments is configured to move between a collapsed position in which each of the plurality of physically separate retention segments does not block movement of the first component relative to a second component of the system and an engaged position in which each of the plurality of physically separate retention segments engages and extends radially into at least one corresponding slot formed in the second component to block movement of the first component relative to the second component, wherein each of the plurality of physically separate retention segments comprises an oscillating cross-sectional shape that extends along a respective length of each of the plurality of physically separate retention segments and that extends in a circumferential direction of the first component of the system when the plurality of physically separate retention segments are coupled to the first component, and the oscillating cross-sectional shape comprises at least one peak region and at least one valley region that enables each of the plurality of physically separate retention segments to move between the collapsed position and the engaged position, wherein the cross-section is taken along a plane extending between a radial-inner surface and a radially-outer surface of the at least one retention segment, wherein the at least one retention segment comprises a spring-like member.

15. The system of claim 14, wherein the plurality of physically separate retention segments are positioned at discrete locations about a circumference of the first component.

16. The system of claim 14, wherein the first component is a hanger and the second component is a housing of a wellhead.

17. The system of claim 16, wherein each of the plurality of physically separate retention segments is coupled to the hanger via a respective threaded fastener positioned at the at least one valley region.

18. The system of claim 14, wherein each of the plurality of physically separate retention segments comprise a spring-like member, and the at least one peak region of each of the plurality of physically separate retention segments is biased away from the first component such that a radially-inner surface of each of the plurality of physically separate retention segments is separated from a radially-outer surface of the first component by a first radial distance while each of the plurality of physically separate retention segments is in the engaged position, and wherein the radially-inner surface contacts the radially-outer surface of the first component or is separated from the radially-outer surface of the first component by a second radial distance less than the first radial distance while each of the plurality of physically separate retention segments is in the collapsed position.

19. The system of claim 14, wherein each of the plurality of physically separate retention segments comprises a tapered lower surface extending at a first angle relative to a radial axis and an upper engaging surface extending at a second angle relative to the radial axis, and the first angle is greater than the second angle.

20. The system of claim 14, wherein each of the physically separate retention segments is configured to extend circumferentially about less than half of a circumference of the first component.

* * * * *